United States Patent [19]

Fisher et al.

[11] 4,398,546

[45] Aug. 16, 1983

[54] INSPECTION APPARATUS

[75] Inventors: Paul S. Fisher, Carnmoney; Robert W. McLoughlin, Bangor, both of Northern Ireland

[73] Assignee: Gallaher Limited, London, England

[21] Appl. No.: 272,165

[22] Filed: Jun. 10, 1981

[30] Foreign Application Priority Data

Jun. 23, 1980 [GB] United Kingdom ..... 8020499

[51] Int. Cl.[3] ..... A24C 5/00; A24C 5/20

[52] U.S. Cl. ..... 131/88; 131/95

[58] Field of Search ..... 131/280, 281, 27 R, 131/27 A, 28, 29, 32, 33, 81, 34, 35, 36, 58, 60–61 B, 88, 91, 94, 95, 907, 910

[56] References Cited

U.S. PATENT DOCUMENTS

| | | | |
|---|---|---|---|
| 4,240,448 | 12/1980 | Heitmann et al. | 131/281 |
| 4,265,254 | 5/1981 | Koch et al. | 131/281 |
| 4,282,889 | 8/1981 | Dahlgrun | 131/281 |

FOREIGN PATENT DOCUMENTS

| | | |
|---|---|---|
| 2749174 | 5/1979 | Fed. Rep. of Germany . |
| 795480 | 5/1958 | United Kingdom . |
| 1087094 | 10/1967 | United Kingdom . |

*Primary Examiner*—V. Millin

*Attorney, Agent, or Firm*—Andrus, Sceales, Starke & Sawall

[57] ABSTRACT

In a cigarette tipping machine an apparatus for monitoring the size and position of cork patches (12) comprises a rotary knife (13) which cooperates with the surface of a rotary drum (11) to cut a strip (10) of material into a series of spaced patches (12). At the instant of cut a generator (15) produces a reference signal and when the leading edge of a patch passes an optical detecting head (14) a patch signal is produced. The reference and patch signals are processed in a circuit (16) and a fault signal is produced if the delay between the two pulses is outside an acceptable range.

5 Claims, 7 Drawing Figures

INSPECTION APPARATUS

The invention relates to apparatus for automatically monitoring patches cut from a strip of material. Although the invention is applicable in other fields we are particularly interested in its application to machines for cutting a patch and wrapping the patch as a band around the mouthpiece end of a substantially cylindrical smoking product, such as a cigarette, cigar and cigarillo. For example, in a cigarette cork tipping machine, a strip of simulated cork paper is cut into rectangular patches which are conveyed to a wrapping station where they are wrapped around and unite a length of tobacco rod and a filter plug. Alternatively, the patch may be a paper patch which is wrapped around the mouthpiece end of a cigarillo to connect a plastics or other mouthpiece to the tobacco rod.

Flaws in such patches, such as chips or tears in the cut edges, patches cut too short, or patches not conveyed square to the direction of travel or displaced to one side of the correct path, lead to a finished cigarette which must be rejected. With the advent of modern high speed tipping machinery, such patch flaws have tended to occur more frequently and have become more likely to escape notice due to the higher speeds and reduced opportunity for visual inspection. Conventional cigarette inspection apparatus contains means for measuring the pressure drop caused by leaks in the surface of the cigarette assembly when air suction or pressure is applied. Such methods have become more difficult to operate at higher speeds and less effective in detecting faulty cigarettes resulting from cork patch flaws when surface leakage has been deliberately introduced, as is the case with modern ventilated cigarettes.

The object of the invention is to provide a means of detecting cork patch faults, or similar faults in patches in analogous applications, without the speed and sensitivity limitations inherent in the conventional inspection apparatus.

It is known from British Pat. No. 795,480 to sense optically at separate positions the passage of the leading and trailing edges of each of a series of sheets carried by a conveyor after being cut by flying shears from a strip of metal. This requires two optical sensors, such as light beams which are interrupted by the edges of the sheet. However this technique is not suitable for monitoring patches, such as cork patches, which are cut by the action of a knife against the surface of a drum or other conveyor on the surface of which the cut patches are carried. This is because the repetitive impingement of the knife against the same part of the drum leaves groove lines on the drum which would be difficult to distinguish from the trailing edge of a patch and would lead to spurious signals.

In accordance with the present invention, an inspection apparatus for monitoring patches cut from a strip of material comprises a conveyor for a series of spaced cut patches, a knife which cooperates with the conveyor surface to cut patches from a strip of material fed to the conveyor, a reference signal generator which produces a reference signal representing the time at which the knife performs a cutting operation, a detector unit mounted adjacent to the conveyor downstream of the knife by a distance greater than the largest expected patch length, and arranged to produce a patch signal representing the time at which the leading edge of a patch reaches the detector unit, and means for determining whether the delay between the reference signal and patch signal falls within acceptable limits and for producing a corresponding output.

Since the knife cooperates directly with the conveyor to cut the strip, the trailing edge of each patch is accurately positioned relatively to the conveyor, the speed of which will be known. Monitoring of the arrival of the leading edge of each patch by the detector unit will then provide an accurate determination of the patch length, upon processing of the reference and patch signals. The leading edge of each patch will be spaced from the trailing edge of the preceding patch and will be positioned at a clean part of the conveyor where an accurate sensing of the leading edge may be obtained. The reference signal can be obtained very simply from the action of the knife and only a single detector unit is required for sensing the passage of an edge of the patch and producing the patch signal. The output signals may be selectively fed to a cigarette or other product tracking and rejection mechanism so that products made from faulty patches are automatically rejected.

As in conventional cigarette cork tipping machines, the conveyor may be a rotary drum to the periphery of which the patches are retained by suction. The strip of material is fed to the drum at a speed slightly slower than the peripheral speed of the drum so that the patches are spaced apart about the periphery of the drum. This facilitates the operation of the detector unit in accordance with the invention.

The detector unit preferably operates by means of a reflection technique, the patches on the conveyor being irradiated by light in the visible or infra-red spectra and the light reflected from the patches and conveyor sensed by one or more photoelectric sensors the output of which will discriminate between the light reflected from a patch and the light reflected from a surface of the conveyor. A single sensor is sufficient to determine patch length but more detail will be obtainable if two or more sensors are provided spaced transversely of the direction of travel of the conveyor. If two sensors are provided one positioned just inwardly of the side edge of each patch when in its correct position on the conveyor, the detector unit will, in conjunction with appropriate process circuitry, be capable of monitoring patch length, the lateral position of the patch on the conveyor, and any angular misorientation of the patch on the conveyor. These latter two features are as important as patch length in the subsequent automatic assembly of the patch, for example in a cigarette.

An example of an inspection apparatus for use with a cigarette cork tipping machine, and constructed in accordance with the invention, and its function, are illustrated diagrammatically in the accompanying drawings, in which.

Figure 1:
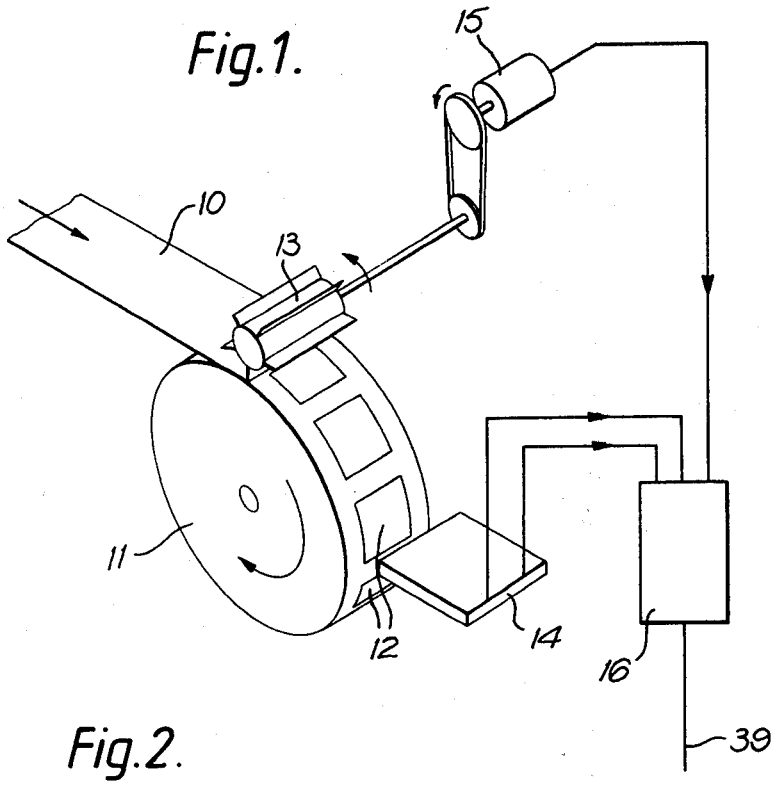
FIG. 1 is a perspective view of the apparatus.

As shown in FIG. 1, cork paper strip 10 is fed to the periphery of a cutting drum 11 which is provided with a series of small holes with suction applied to tension the cork strip lightly and to hold down cut cork patches 12. A rotating multi-bladed knife 13 cuts the cork strip into the patches 12 of the required constant length. The cork paper feed is controlled to a speed lower than the cutting drum peripheral speed so that the cork patches are accelerated to a higher speed after they are cut, leaving a gap between each adjacent pair of patches on the drum. The position of the trailing edge of each patch is thus defined by the knife, whose position and cutting instant are known. It is therefore only necessary to know the position of the leading edge of the patch, with due allowance for drum rotation, to determine the length of the patch. The system operates by detecting with a detector head 14 the arrival of the different sections of the leading edge of each cork patch and deciding whether they arrive early, late or at the correct time. The frame of reference for making this decision is set by a train of pulses from a pulse generator 15 which is directly linked to the rotational position of the knife.

The detector head contains a number of reflective sensors each designed to direct light (e.g. infra-red or visible) over a small area of the cork drum surface, and to receive light reflected back from that area.

Figure 2:
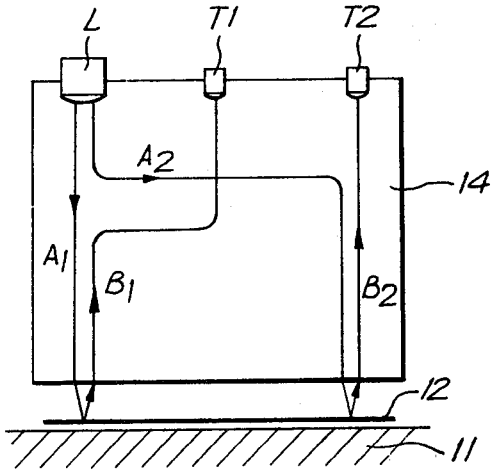
FIG. 2 is a side view of a detector unit of the apparatus.
Figure 3:
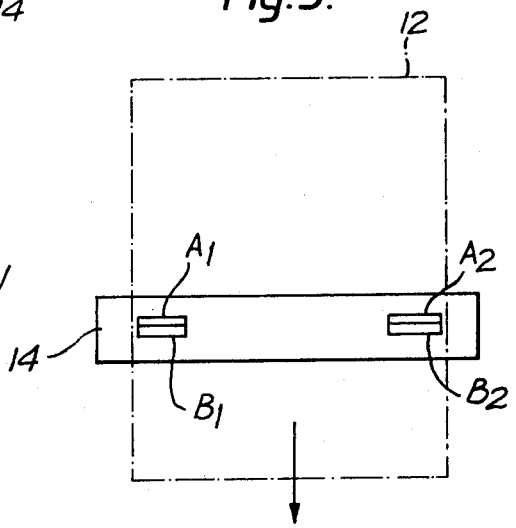
FIG. 3 is an underneath plan of the detector unit of FIG. 2.

The construction of one possible version of detector head is shown in FIGS. 2 and 3. It comprises a metal block containing four fibre light guides A1, A2, B1, B2, each guide composed of a bundle of light conducting fibres. A1 and A2 conduct light from lamp L to each of two windows positioned at each side of one edge of the block and direct light towards the drum at areas just inside the side edges of the cork patches 12. B1 and B2 direct reflected light back to photo-sensitive detectors T1 and T2. T1 and T2 convert the reflected light energy into a corresponding electric current signal.

Figure 4:
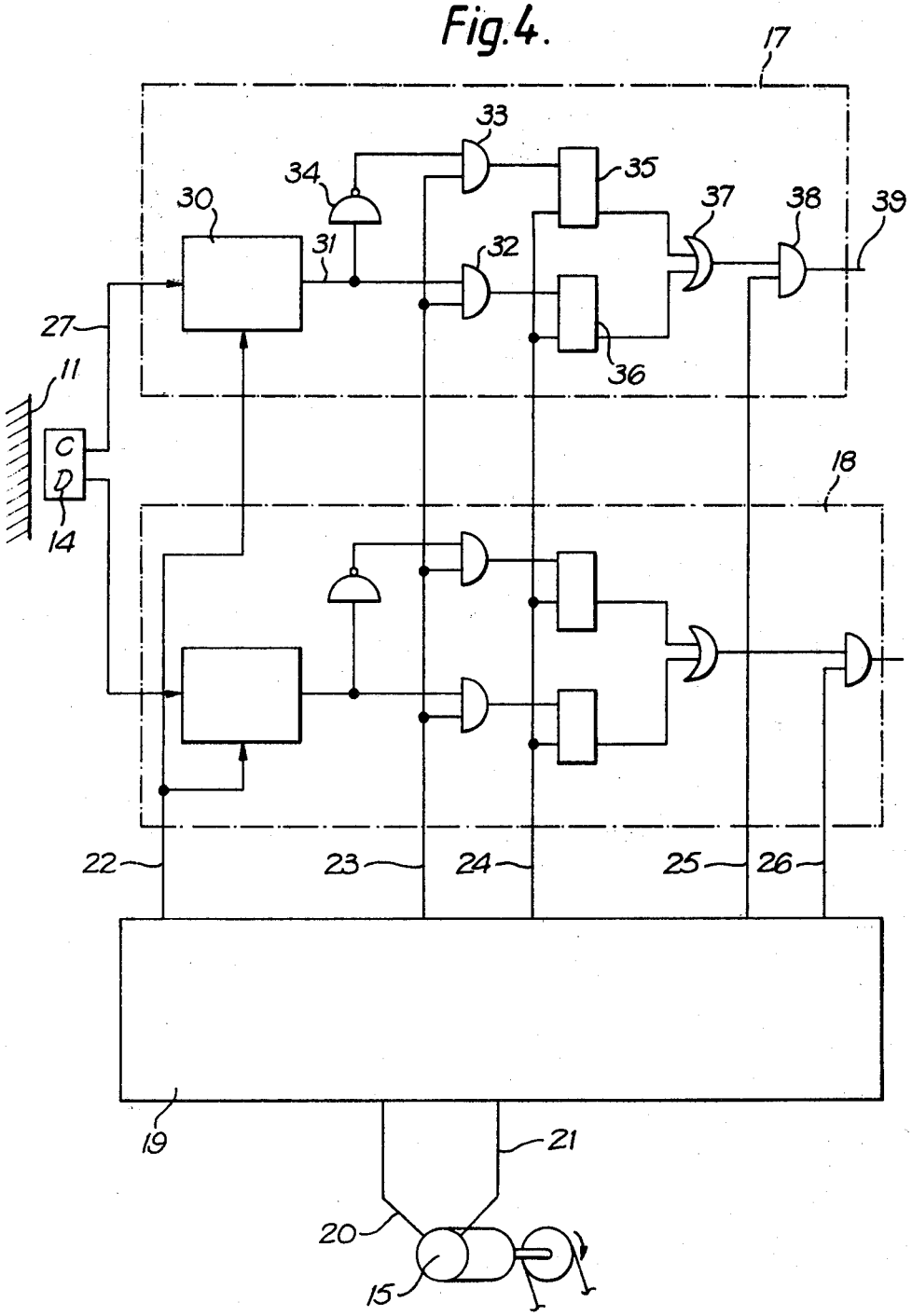
FIG. 4 shows a signal processing circuit for the apparatus.

FIG. 4 shows one possible version of an electronic circuit 16 to process the signals from the sensors and produce fault pulses when a faulty patch is detected.

Figure 5:
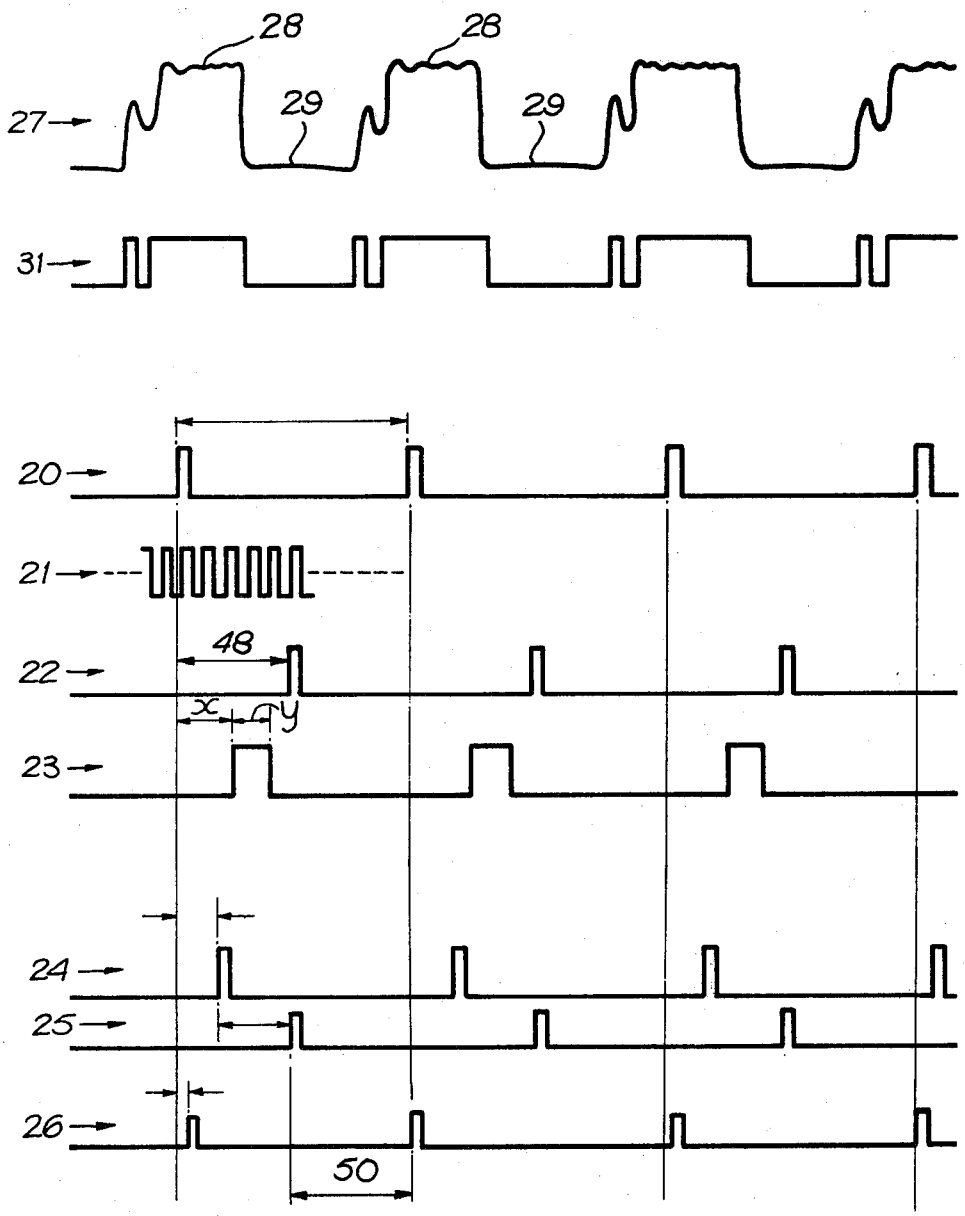
FIGS. 5 and 6 are pulse timing diagrams relating to the operation of the apparatus; and, FIG. 7 illustrates a compensated signal shaping circuit of the apparatus.

The circuit comprises two identical channels C and D to shape and process the signals from the two detectors T1 and T2. The control pulses to operate two signal shaping and processing, circuits, 17 and 18 are generated in a common pulse processing circuit 19. The pulse trains generated by this circuit are shown in FIG. 5. The inputs to the pulse processing circuit 19 are two pulse trains 20 and 21 produced by the reference pulse generator 15. Pulse train 20 comprises a train of pulses generated once per knife cut and pulse train 21 is a continuous train of 100 pulses per knife cut in synchronism with the pulse train 20.

The pulse processing circuit generates five separate trains of pulses 22, 23, 24, 25 and 26 which are locked in synchronism with the input pulses 20 and 21 and perform the necessary functions in the signal shaping and processing circuits described below. The pulse 22 is a sample/hold pulse which occurs typically 48 segment pulses after the reference pulse 20. The pulse 23 is a gate pulse which starts at a specified interval of x segment pulses after the reference pulse 20 and finishes y segment pulses later. The values x and y are pre-selected and are adjusted to suitable values when setting up the equipment. Typical values for x and y are 18 and 20 segment pulses respectively.

The pulse 24 is a fault register reset pulse which occurs a fixed number of segment pulses after the reference pulse 20. The pulse 25 is a C channel cigarette fault strobe pulse which occurs a preselectable number of segments after the reference pulse 20. The pulse 26 is a D channel cigarette fault strobe pulse which occurs 50 segment pulses after the C channel cigarette fault strobe pulse 25.

The internal operation of the pulse processing circuit uses conventional counting, decoding and logic circuits well known to those skilled in the art and will not be described in detail here.

The two outputs (channels C and D) from the detector unit 14 feed the separate identical circuits 17 and 18 which shape the signal for processing in digital form, perform logical decisions, and produce a correctly timed fault pulse when a faulty cork is detected.

Figure 6:
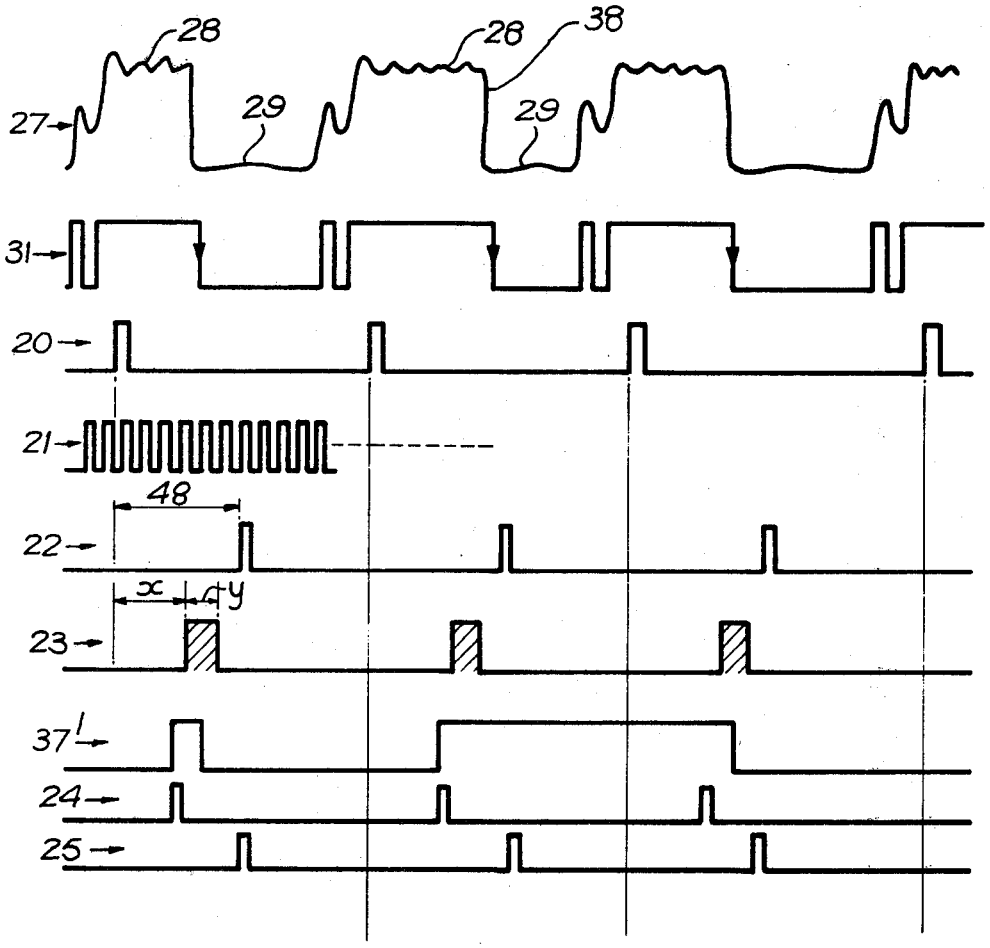

In FIG. 4, consider circuit 17 which processes the C side signal. The appropriate waveforms and pulse timings are shown in FIG. 6.

A sensor output signal 27 is a rough square wave in which the upper level 28 results from reflection from the drum surface and the lower level 29 from reflection from the cork patch. It is found in practice that the reflected signal from the drum surface is very variable and subject to peaks and troughs caused by marks on the drum surface whereas the signal from the cork is more even and normally lower than the signal from the drum. The change from drum to cork signal at the patch leading edge normally follows a smooth transition from high to low level whereas the trailing edge transition from cork to drum signal often shows peaks and troughs caused by grooves in the drum surface left by the rotating cork knife.

Figure 7:
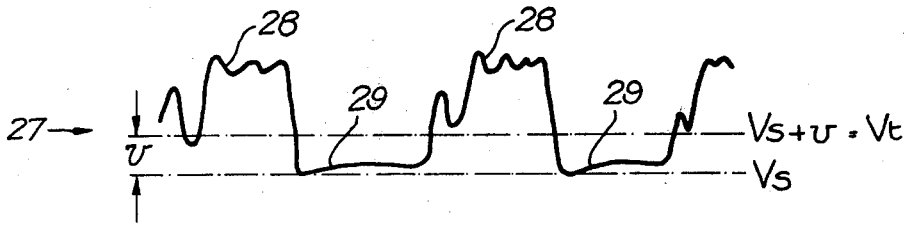
Figure 7:
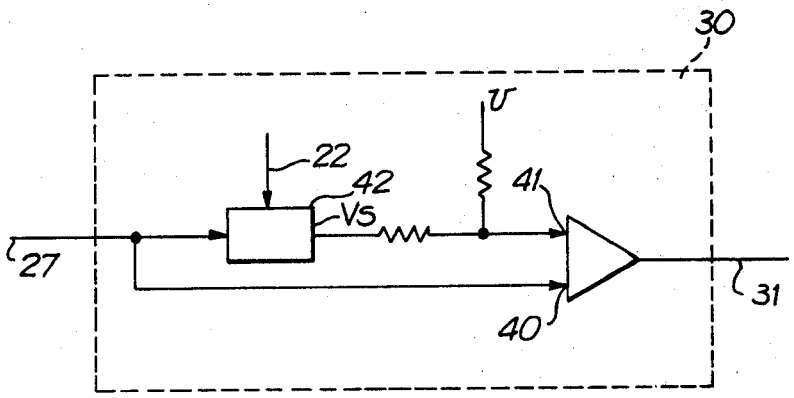

The sensor signal 27 is fed to a shaping circuit 30, which will be described later and is illustrated in FIG. 7, and which shapes the signal into a waveform 31 which switches cleanly between a fixed upper and lower limit. The instant at which the leading edge of the patch passes the detector head 14 is defined by the high to low transition marked with an arrow on waveform 31 (FIG. 6).

The shaped sensor signal 31 is fed to AND gate 32, and to AND gate 33 via inverter 34.

The gate pulse 23 is fed to AND gates 32 and 33. The outputs of gates 32 and 33 feed the SET input terminals of set-reset flip-flops 35 and 36. The RESET terminals of flip-flops 35 and 36 are fed by the fault-register reset pulse 24. The flip-flops 35 and 36 are both forced to the RESET state by the pulse 24 which occurs during the drum portion of the sensor signal before the expected cork leading edge transition. The AND gates 32 and 33 are then enabled by gate pulse 23. Gate pulse 23 forms a window during which the patch leading edge transition is expected to occur. The start and finish times of the gate pulse can be adjusted in increments of one segment pulse. These times define the start and finish of the period during which the patch leading edge must occur if the patch is to be classified as acceptable.

For an acceptable patch, a transition from high to low level will occur on waveform 31 and a corresponding low to high transition will occur at the output of inverter 34 during the gate pulse 23. Since AND gates 32 and 33 are enabled at this time both flip-flops 35 and 36 will be set to the SET condition by the end of the gate pulse 23 since both the waveform 31 and the output of the inverter 34 have been high at some time during this period.

On completion of gate pulse 23 the reset outputs of both flip-flops 35 and 36 will be at low level and hence the output of OR gate 37 will also be at low level.

The state of the output of OR gate 37 is now tested by the C channel fault strobe 25 which enables AND gate 38. Since OR gate 37 output is at low level at this time no fault pulse is passed to a fault pulse output 39.

For an unacceptable cork patch, the transition on the signal 31 will occur outside the "window" period of the gate pulse 23. If the leading edge is too early signal 31 will be low during the window. If the leading edge is too late signal 31 will be high during the window.

If the edge is early, gate 32 will be fed with a low level during the "window" and flip-flop 36 will remain in the RESET state.

If the edge is late, gate 33 will be fed with a low level during the "window" and flip-flop 35 will remain in the RESET state.

In either of these two cases OR gate 37 will have a high level at its output when the C channel fault strobe 25 occurs. In this case a fault pulse will be passed to the fault pulse output at 39.

FIG. 6 shows the timing of these events for both an acceptable and an unacceptable patch. It can be seen that waveform 37', at the output of OR gate 37, remains high (Fault Condition) after completion of the gate pulse when there is a faulty patch with a late edge 38, and continues high until the next acceptable cork patch is detected.

The D channel shaping and processing circuit 18 operates in an identical manner to circuit 17 and produces fault pulses for the D channel side of each cork patch. The D channel fault strobe pulse 26 occurs 50 segment pulses (or half of one cork patch period) later to enable the C and D fault pulses to be identified separately in the subsequent cigarette tracking and rejection circuits. The C and D fault pulses may be combined on to a single line, using an OR gate, if the subsequent tracking circuits can accept them in this form. The cork patch is subsequently used to unite two cigarette rod lengths before being cut in half to separate the two lengths. This accounts for the need for two potential fault pulses so that only one half patch/cigarette length needs to be rejected in the event of a fault on only one side of the patch.

The signal shaper circuit 30 will now be described in more detail. As shown in FIG. 7, the shaping of the sensor signal is performed by a comparator circuit whose output level switches to either a high or low level depending on whether the input signal at a terminal 40 is more positive or more negative than a reference trigger level Vt at a terminal 41. The position of the reference level Vt relative to the signal 27 is shown in FIG. 7.

If Vt were made a fixed voltage level then the circuit could only operate reliably if the voltage levels of the signal 27 remained fixed. In practice the detector head sensor output signal is subject to large and unpredictable changes of amplitude and voltage level caused by such factors as dust or moisture on the sensor optics, ageing and temperature effects on the lamp or photosensors, and variations in drum and cork reflectivity. To overcome this problem the shaping circuit trigger level Vt is derived from the voltage level of waveform 27 during the patch period and is controlled to remain at a predetermined voltage above the patch signal level.

The circuit operates by sampling and holding the patch signal level Vs at about the middle of the patch period each time a patch signal appears. The level Vs thus sampled and held is added to a predetermined voltage v (typically a few hundred millivolts) and used as the trigger level Vt for the following patch signal. This is shown in diagrammatic form in FIG. 7. A sample/hold circuit 42 is activated to take a sample by sample/hold pulse 22 derived from the pulse processing circuit as shown in FIGS. 5 and 6.

Correct operation of the trigger circuit depends on the presence of a patch when the sample/hold pulse occurs. If this is not so the drum signal will be sampled which will result in the wrong level of trigger level Vt for the next patch. This occurrence can be prevented by suppressing the sample/hold pulse for any patch that is detected as faulty (including a missing patch). The sample/hold circuit will then retain the level held from the last acceptable patch.

Another consideration is that during the start-up period of the tipping machine there will be no patches present on the drum to establish a suitable sample/hold level to enable the shaping circuit to start to give a meaningful signal. This may be overcome by allowing the sample/hold pulse to occur continually during the startup phase until a more or less continous stream of patches is established, after which the sample/hold system works normally.

Referring to FIG. 7, an alternative way of deriving the trigger voltage Vt is to multiply the sampled voltage Vs by a constant factor k so that $Vt=kVs$, where k lies within the range 1 to 1.5.

In the case of a cigarette tipping machine, as shown in FIG. 1, patches giving early arrival of the leading edge do not normally occur. This can lead to slight simplification of the circuitry, because the leading edge of gate pulse 11 becomes less critical and may be allowed to occur earlier. For example the leading edge of gate pulse 23 may start at the leading edge of reference pulse 22, so that delay $x=o$.

We claim:

1. An inspection apparatus for monitoring patches of material, said apparatus comprising a conveyor for a series of spaced cut patches, a knife adapted to cooperate with said conveyor surface to cut patches from a strip of material fed to said conveyor, a reference signal generator adapted to produce a reference signal representing the time at which said knife performs a cutting operation, a detector unit mounted adjacent to said conveyor downstream of said knife by a distance greater than the largest expected patch length, and adapted to produce a patch signal representing the time at which the leading edge of each of said patches reaches said detector unit, and means for determining whether the delay between said reference signal and said patch signal falls within acceptable limits and for producing an output indicative thereof.

2. An apparatus according to claim 1, wherein said conveyor is a rotary drum; and means are provided for producing a suction at a periphery of said drum to retain said patches thereon.

3. An apparatus according to claim 1, wherein said detector unit utilizes an optical reflection technique, means being provided for irradiating said conveyor with light and there being one or more photoelectric sensors for sensing light reflected from said patches and conveyor and for producing a different output depending on whether said sensed light has been reflected from one of said patches or from a surface of said conveyor.

4. An apparatus according to claim 3, wherein two or more of said sensors are provided spaced transversely of the direction of travel of said conveyor.

5. An apparatus according to claim 4, wherein two of said sensors are provided one positioned just inwardly of each side edge of one of said patches when said one patch is in its correct position on the conveyor.

* * * * *